US005241975A

United States Patent [19]

Yanagihara

[11] Patent Number: 5,241,975

[45] Date of Patent: Sep. 7, 1993

[54] DISHWASHER

[75] Inventor: Masanobu Yanagihara, Gifu, Japan

[73] Assignee: Kabushiki Kaisha Toshiba, Kawasaki, Japan

[21] Appl. No.: 840,878

[22] Filed: Feb. 25, 1992

[30] Foreign Application Priority Data

Mar. 5, 1991 [JP] Japan ..... 3-064024

[51] Int. Cl.[5] ..... B08B 3/02

[52] U.S. Cl. ..... 134/56 D; 134/176; 134/179; 134/182

[58] Field of Search ..... 134/56 D, 57 D, 58 D, 134/176, 177, 182; 417/423.7

[56] References Cited

U.S. PATENT DOCUMENTS

| | | | |
|---|---|---|---|
| 3,064,665 | 11/1962 | Martiniak | 134/176 |
| 3,077,200 | 2/1963 | Guth | 134/176 |
| 3,134,386 | 5/1964 | Jenkins | 134/176 X |
| 3,168,868 | 2/1965 | Schultz | 417/423.7 |
| 3,253,784 | 5/1966 | Long et al. | 134/176 U X |
| 3,280,751 | 10/1966 | Ekey | 417/423.7 |
| 3,288,156 | 11/1966 | Jordan et al. | 134/176 X |
| 3,648,931 | 3/1972 | Jacobs | 134/179 X |
| 3,841,342 | 10/1974 | Cushing et al. | 134/176 X |
| 3,989,054 | 11/1976 | Mercer | 134/176 X |
| 4,172,463 | 10/1979 | Woolley et al. | 134/176 |
| 4,509,687 | 4/1985 | Cushing . | |
| 4,511,312 | 4/1985 | Hartwig | 417/423.7 |
| 4,732,323 | 3/1988 | Jarvis et al. . | |

FOREIGN PATENT DOCUMENTS 2-140126 5/1990 Japan .

*Primary Examiner*—Frankie L. Stinson
*Attorney, Agent, or Firm*—Limbach & Limbach

[57] ABSTRACT

A dishwasher includes a washing compartment defined in a cabinet for containing tableware and reserving a predetermined amount of wash liquid on the bottom, a wash pump sucking the wash liquid reserved in the washing compartment and feeding the liquid, a spray nozzle mounted in the washing compartment so as to be vertically moved, to receive the wash liquid fed from the wash pump and to spray the wash liquid to the tableware, and feed liquid pressure changing means for changing a pressure of the wash liquid fed to the spray nozzle during washing the tableware with the wash liquid sprayed from the spray nozzle so that the wash liquid pressure is increased and decreased at a plurality of times, thereby reciprocally driving the spray nozzle vertically at a plurality of times.

6 Claims, 6 Drawing Sheets

DISHWASHER

BACKGROUND OF THE INVENTION

This invention relates to a dishwasher for washing tableware such as dishes contained in a washing compartment by spraying wash liquid to the tableware.

In conventional dishwashers, a spray arm and an spray nozzle are provided in a washing compartment and a predetermined amount of wash liquid fed from a wash pump is sprayed from the spray arm or nozzle to the tableware contained in the washing compartment, thereby washing the tableware.

In the above-described conventional construction, however, a range of space in which the wash liquid is sprayed by the spray arm or nozzle is fixed, resulting in a dead space where the wash liquid does not reach the tableware. This causes a problem that stains are difficult to be removed from the tableware. Furthermore, since the tableware should not be placed in the dead space in the washing compartment, the space in the washing compartment where the tableware is placed is limited, which causes a problem that the dishwasher is not convenient.

Japanese Laid-open Patent Application (Kokai) No. 2-140126 discloses a dishwasher wherein the pressure of the wash liquid fed to the spray nozzle causes the nozzle to rise in the washing compartment. However, since the spray nozzle is held at the raised position during the washing operation, the range of space in which the wash liquid is sprayed by the spray arm or nozzle is still fixed and the washing performance and the convenience of the dishwasher still remains unimproved.

SUMMARY OF THE INVENTION

Therefore, an object of the present invention is to provide a dishwasher wherein the wash liquid is sprayed to sufficiently reach the tableware in the washing compartment and thereby, its washing performance and convenience can be improved.

In one aspect of the present invention, a dishwasher comprises a washing compartment defined in a cabinet for accommodating tableware and reserving a predetermined amount of wash liquid on the bottom, a wash pump sucking the wash liquid reserved in the washing compartment and feeding the same, a spray nozzle mounted in the washing compartment so as to be vertically moved and to be fed with the wash liquid from the wash pump and to spray the wash liquid to the tableware, and feed liquid pressure changing means for changing a pressure of the wash liquid fed to the spray nozzle during washing the tableware with the wash liquid sprayed from the spray nozzle so that the wash liquid pressure is increased and decreased at a plurality of times, thereby reciprocally driving the spray nozzle vertically at a plurality of times.

In accordance with the above-described construction, the spray nozzle is vertically moved in the washing compartment while the tableware is being washed. Accordingly, the wash liquid sprayed from the vertically moved spray nozzle covers a wide range of space in the washing compartment. Consequently, the dead space where the wash liquid does not reach the tableware can be prevented from being resulted. Thus, the washing performance of the dishwasher can be improved and the placing of the tableware in the washing compartment cannot be limited, resulting in improvement in convenience of the dishwasher.

It is also preferable that the wash pump comprise a drive motor and the feed liquid pressure changing means comprise rotational speed control means for controlling the rotational speed of the drive motor of the wash pump. When the rotational speed of the drive motor is controlled by the rotational speed control means, the pressure of the wash liquid fed from the wash pump is changed. Accordingly, since the pressure of the wash liquid fed to the spray nozzle is changed, the spray nozzle is moved vertically in accordance with the change of the feed liquid pressure.

The rotational speed changing means may comprise inverter control means for controlling the frequency of a power supply to the drive motor of the wash pump. Further, the rotational speed changing means may comprise voltage control means for controlling a power supply voltage applied to the drive motor of the wash pump.

The above-described dishwasher may further comprise a spray arm rotatably mounted in the washing compartment fed with the wash liquid form the wash pump and spraying the wash liquid to the tableware from below the tableware and a liquid feed path having an arm side liquid feed port from which the wash liquid from the wash pump is fed to the spray arm, a nozzle side liquid feed port from which the wash liquid from the wash pump is fed to the spray nozzle flow rate adjusting means varying an area of opening of the arm side liquid feed port in accordance with rotation of the spray arm for adjusting the flow rate of the wash liquid flowing through the arm side liquid feed port. The feed liquid pressure changing means may comprise the flow rate adjusting means.

The pressure of the wash liquid flowing through the liquid feed path is varied when the flow rate of the washing liquid flowing through the arm side liquid feed port is adjusted by the flow rate adjusting means while the wash liquid is being fed with a given pressure from the wash pump, resulting in the change of the pressure of the wash liquid fed from the liquid feed path to the spray nozzle through the nozzle side liquid feed port. More specifically, although the wash liquid is fed with the given pressure from the wash pump, the pressure of the wash liquid fed to the spray nozzle is changed, which causes the spray nozzle to be vertically moved in accordance with the change of the feed liquid pressure.

The above-described spray arm may be rotatable and the flow rate adjusting means may vary the degree of opening of the arm side liquid feed port in accordance with rotation of the spray arm. The spray nozzle can be driven by the drive source for rotating the spray arm since the spray nozzle is vertically moved with rotation of the spray arm.

In another aspect of the invention, a dishwasher comprises a washing compartment defined in a cabinet for containing tableware and reserving a predetermined amount of wash liquid on the bottom, a wash pump sucking the wash liquid reserved in the washing compartment and feeding the wash liquid, the wash pump including a drive motor, a cylindrical liquid feed member standing on the bottom of the washing compartment for receiving the wash liquid from the wash pump, the cylindrical liquid feed member having an upper end opening, a spray arm rotatably mounted on the upper portion of the cylindrical liquid feed member for spraying the wash liquid therefrom to the tableware from below the tableware, a cylindrical nozzle support member mounted on the spray arm so as to be communicated to the upper end opening of the cylindrical liquid feed member, a spray nozzle inserted in the cylindrical nozzle support member so as to be vertically moved, the spray nozzle receiving the wash liquid fed from the cylindrical liquid feed member and the cylindrical nozzle support member to spray the wash liquid to the tableware, a spring interposed between the spray nozzle and the cylindrical nozzle support member for urging the spray nozzle downwards, and rotational speed control means for controlling the rotational speed of the drive motor of the wash pump so that the pressure of the wash liquid fed to the spray nozzle is varied to be increased and decreased at a plurality of times, thereby reciprocally driving the spray nozzle vertically at a plurality of times during washing the tableware with the wash liquid sprayed from the spray nozzle.

In this construction, too, the wash liquid is sprayed in the wide range of space in the washing compartment since the spray nozzle is driven to be vertically moved. Consequently, the washing performance of the dishwasher can be improved and the placing of the tableware in the washing compartment cannot be limited, resulting in improvement in convenience of the dishwasher.

Other objects of the present invention will become obvious upon understanding of the illustrative embodiments about to be described. Various advantages not referred to herein will occur to one skilled in the art upon employment of the invention in practice.

BRIEF DESCRIPTION OF THE DRAWINGS

The embodiments of the present invention will be described with the accompanying drawings in which.

DESCRIPTION OF THE PREFERRED EMBODIMENTS

Figure 1:
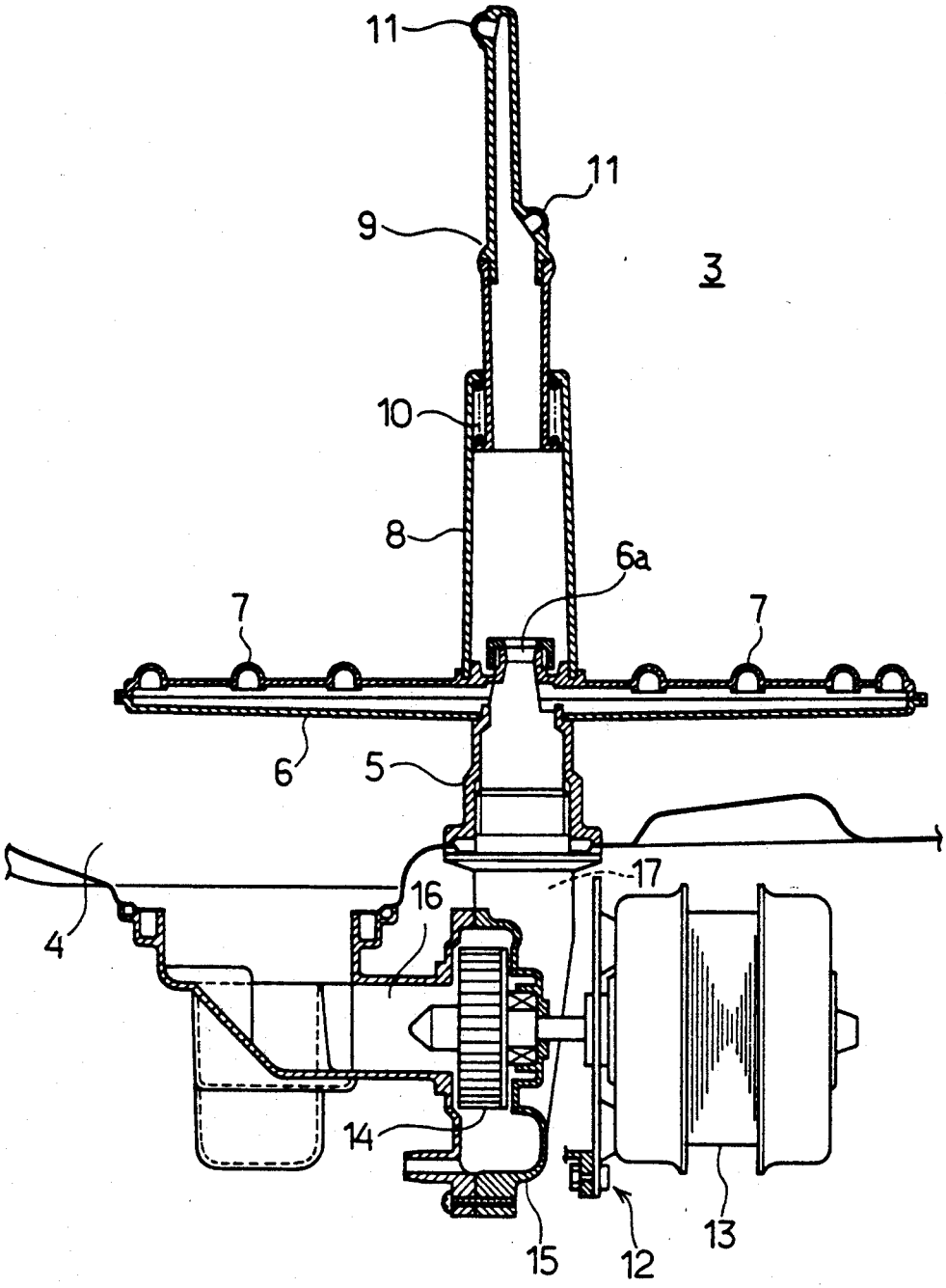
FIG. 1 is a longitudinal side sectional view of a principal portion of a dishwasher in accordance with one embodiment of the present invention.
Figure 2:
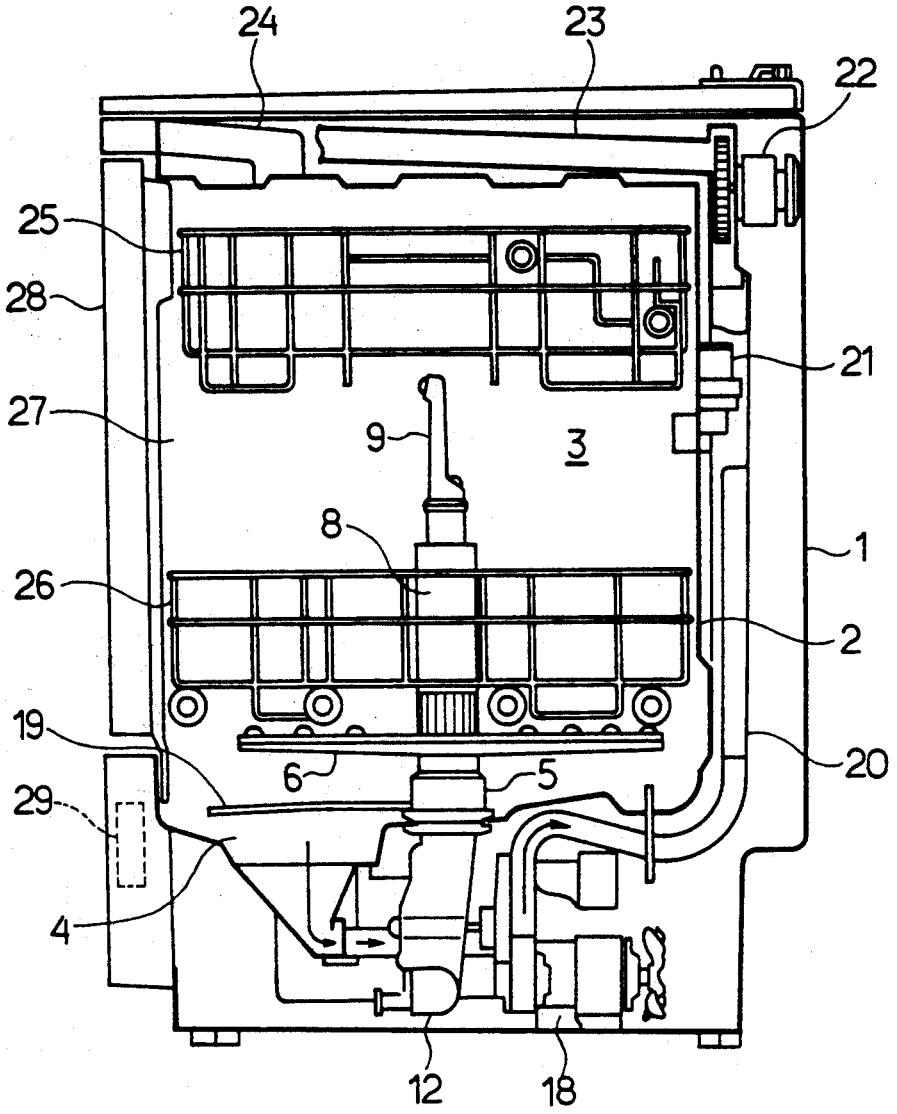
FIG. 2 is a schematic longitudinal side sectional view of the dishwasher.

A first embodiment of the present invention will be described with reference to FIGS. 1 through 4. Referring first to FIG. 2 showing an overall construction of the dishwasher, an outer cabinet 1 encloses an inner cabinet 2 defining therein a washing compartment 3. A wash liquid reserving section 4 is formed on the bottom of the washing compartment 3. A base pipe 5 serving as a cylindrical water feed member stands on the wash liquid reserving section 4, as shown in FIG. 1. A spray arm 6 is rotatably mounted on the upper portion of the base pipe 5. The spray arm 6 is extended from the base pipe 5 in both right-hand and left-hand directions, as viewed in FIG. 1. Several spouts 7 are formed in the upper face of each extended portion of the spray arm 6. A tower pipe 8 serving as a cylindrical nozzle support member is secured to the upper middle portion of the spray arm 6. A spray nozzle 9 is inserted into the tower pipe 8 so as to be vertically movable. A spring 10 is interposed between the tower pipe 8 and the spray nozzle 9 to urge the spray nozzle 9 downwards. A spout 11 is formed in the top of the spray nozzle 9 and another spout 11 is formed in its middle portion.

A wash pump 12 is provided beneath the wash liquid reserving section 4. The wash pump 12 comprises a wash pump motor 13 serving as a drive motor, an impeller 14 driven by the wash pump motor 13 and a casing 15 enclosing the impeller 14. The casing 15 has a suction port 16 communicated to the bottom of the wash liquid reserving section 4 and an exhaust port 17 communicated to the lower end of the base pipe 5. The base pipe 5 has an upper opening communicated to the spray arm 6 and further to the tower pipe 8 and the spray nozzle 9 via a communication port 6*a* formed in the upper middle portion of the spray arm 6.

Referring to FIG. 2, a drain pump 18 is also provided beneath the wash liquid reserving section 4. A heater 19 is provided in the wash liquid reserving section 4 for heating the wash liquid reserved in the section. Further, outside the inner cabinet 2 are provided a drain hose 20, a water supply valve 21, a drying fan 22, a drying air intake duct 23, an exhaust duct 24 and the like. An upper tableware rack 25 is withdrawably mounted on the upper inner wall of the washing compartment 3 and a lower tableware rack 26 is withdrawably mounted on the lower inner wall of the washing compartment 3. The outer cabinet 1 has a front access opening 27 through which the racks 25, 26 are put into and taken out of the washing compartment 3. A door 28 is provided for closing and opening the access opening 27. A control device 29 is provided below the door 28 and an operation panel (not shown) is provided in the front of the outer cabinet 1.

Figure 3:
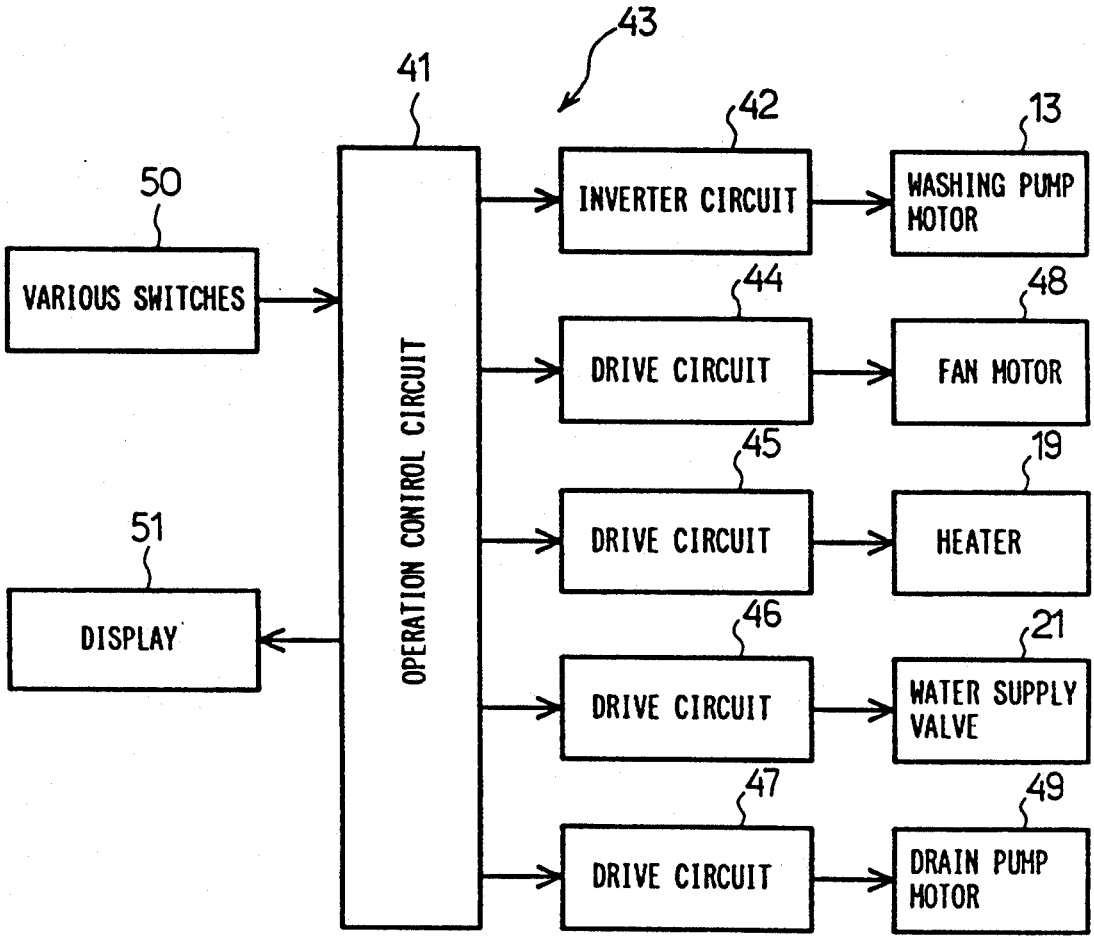
FIG. 3 is a block diagram of a control device employed in the dishwasher.

The control device 29 will be described with reference to FIG. 3. Referring to FIG. 3, an operation control circuit 41 includes a microcomputer incorporating a central processing unit (CPU), memories and the like. An overall operation of the dishwasher is controlled in accordance with a control program whose data is stored in one of the memories. The above-described wash pump motor 13 is controlled via an inverter circuit 42 by the operation control circuit 41. More specifically, an induction motor, for example, is employed as the wash pump motor 13. The inverter circuit 42 is supplied with a control signal from the operation control circuit 41 so that a frequency of the drive power supplied to the wash pump motor 13 is varied by the inverter circuit 42, thereby controlling the rotational speed of the wash pump motor 13. The operation control circuit 41 and the inverter circuit 42 constitute inverter control means 43, which means constitutes both rotational speed control means for controlling the rotational speed of the wash pump motor 13 and feed liquid pressure changing means for changing the pressure of the wash liquid fed to the spray nozzle 9. The above-mentioned inverter control means 43 constitutes nozzle drive means for driving the spray nozzle 9 so that it is vertically moved.

Switch signals are supplied to the operation control circuit 41 from various switches 50 provided in the operation panel. In response to the switch signals from the switches 50, the operation control circuit 41 controls a fan motor 48 of the drying fan 22, the heater 19, the water supply valve 21 and a drain pump motor 49 of the drain pump 18 through respective drive circuits 44 through 47, based on the control program whose data is stored in the memory thereof. Furthermore, the operation control circuit 41 controls a display 51 provided in the operation panel.

Figure 4:
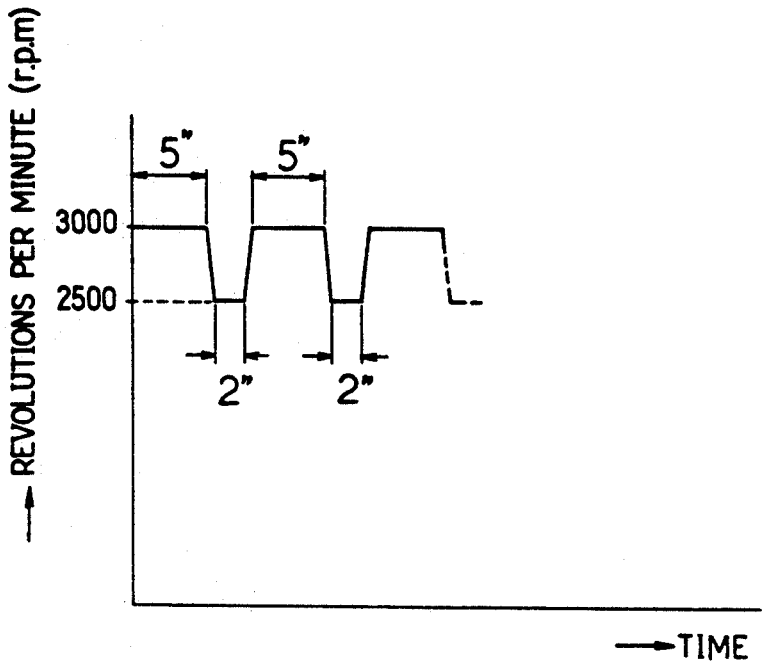
FIG. 4 is a graph showing the changes in the rotational speed of a drive motor of a wash pump.

The operation of the dishwasher will now be described with reference to FIG. 4 as well as FIGS. 1-3. First, the upper and lower racks 25, 26 are taken out of the washing compartment 3. Alternatively, the racks may be partly drawn from the washing compartment 3. Tableware (not shown) to be washed is then placed on the upper and lower racks 25, 26. The racks 25, 26 loaded with the tableware are accommodated in the washing compartment 3 and a suitable amount of detergent is supplied in the washing compartment 3. The door 28 is then closed and the operation of the dishwasher is then initiated. A wash step is first executed. In the wash step, the water supply valve 21 is driven so that a necessary amount of water is supplied into the wash liquid reserving section 4 of the washing compartment 3. Subsequently, the wash pump 12 is driven and the heater 19 is energized. Consequently, the wash liquid heated by the heater 19 is sucked by the wash pump 12. The sucked wash liquid is pressurized and then supplied to the spray arm 6 through the base pipe 5 and to the spray nozzle 9 through the tower pipe 8. Consequently, the wash liquid is sprayed from the spouts 7 of the spray arm 6 against the tableware from below it and simultaneously, the wash liquid is sprayed from the spouts 11 of the spray nozzle 9 against the tableware. In this case a reactive force induced as the result of spraying causes the spray arm 6 to rotate and the feed liquid pressure forces the spray nozzle 9 to rise up against the force of the spring 10.

In the above-described operation, the frequency of the drive power supplied to the wash pump motor 13 is controlled by the operation control circuit 41 and the inverter circuit 42 so that the wash pump motor 13 is driven alternately at the speed of 3,000 r.p.m. for five seconds and then, at the speed of 2,500 r.p.m. for two seconds, repeatedly. As a result, the pressure of the wash liquid supplied from the wash pump 12 to each of the spray arm 6 and nozzle 9 is periodically changed. The spray nozzle 9 is caused to rise up when the feed liquid pressure is high and it is caused to descend under the force of the spring 10 when the feed liquid pressure is reduced. Thus, the spray nozzle 9 is vertically moved as the result of the periodical changes of the feed liquid pressure Since the spray nozzle 9 is vertically moved repeatedly during the wash step, the wash liquid is sprayed in a wide range of space in the washing compartment 3, in contrast to the prior art in which the range of space where the wash liquid is sprayed is fixed. Consequently, the wash liquid can sufficiently reach the tableware placed on the racks 25, 26, resulting in improvement of the washing performance of the dishwasher. Furthermore, the tableware can be disposed in the washing compartment quite freely, thus improving the convenience of the dishwasher.

Upon completion of the wash step, the drain pump 18 is driven so that the wash liquid is drained from the washing compartment 3. Subsequently, rinse and drying steps are executed in turn. In the rinse step, too, the spray nozzle 9 is vertically moved repeatedly in the same manner as in the wash step. The drying fan 22 is driven and the heater 19 is energized in the drying step.

Since the spray nozzle 9 is vertically moved repeatedly in the rinse step, too, the rinsing water can sufficiently reach the tableware, resulting in improvement of the rinsing performance and therefore, the convenience of the dishwasher.

Figure 5:
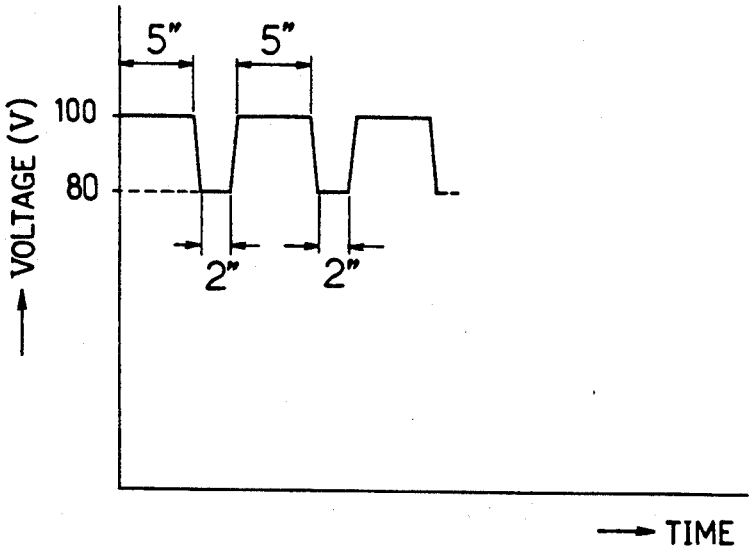
FIG. 5 is a graph showing the changes in the power supply voltage applied to the drive motor of the wash pump in the dishwasher of a second embodiment.
Figure 6:
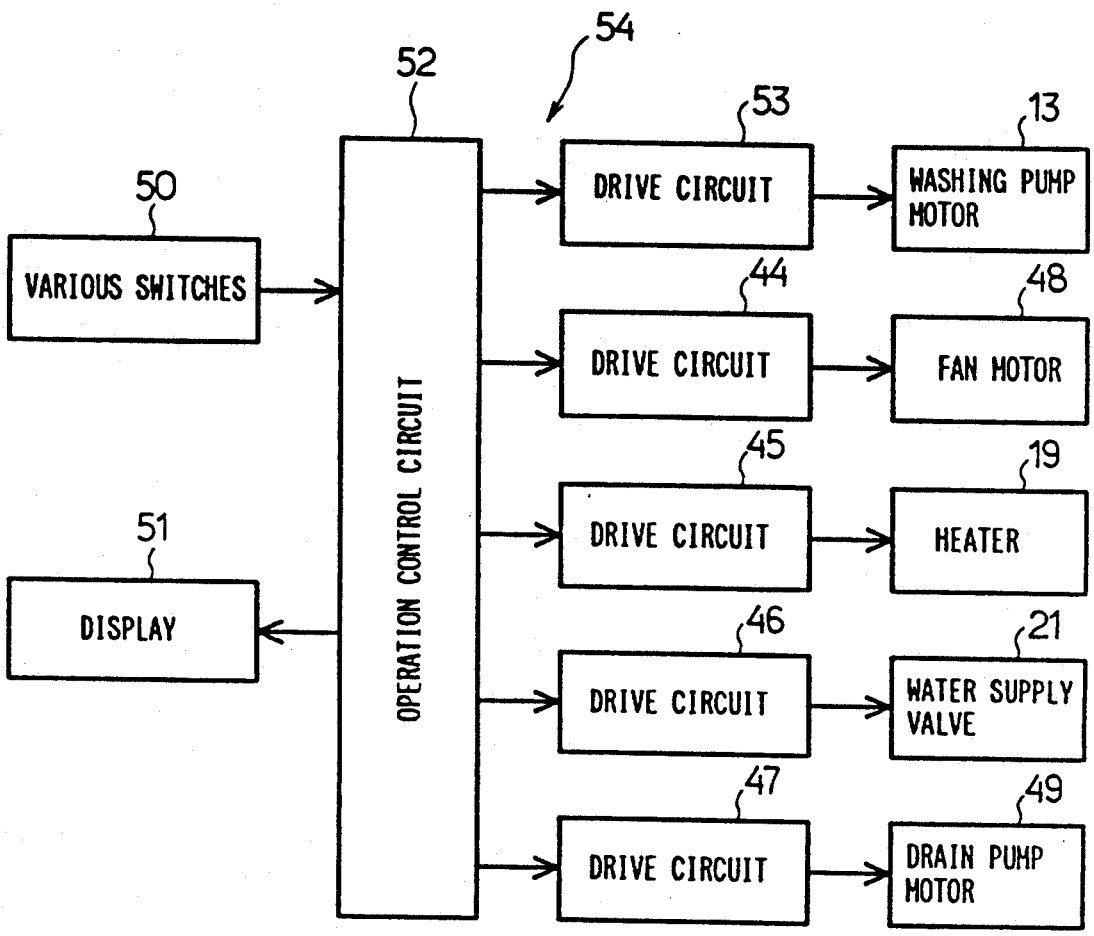
FIG. 6 is a block diagram of the control device employed in the dishwasher of the second embodiment.

FIGS. 5 and 6 illustrate a second embodiment of the present invention. The difference between the first and second embodiments will be described. Referring to FIG. 6, the wash pump motor 13 is controlled through a drive circuit 53 by an operation control circuit 52 employed instead of the circuit 41 in the first embodiment. The drive circuit 53 is a switching circuit comprising a bidirectional triode thyrister or triac, for example and is provided for controlling the wash pump motor 13 so that it is energized and deenergized. The control signal is supplied from the operation control circuit 52 to the drive circuit 53 and a power supply voltage applied to the wash pump motor 13 is varied, thereby controlling the rotational speed of the wash pump motor 13. More specifically, the wash pump motor 13 is energized for a period corresponding to several cycles of the a.c. power supply and deenergized for a period corresponding to several cycles of the a.c. power supply, repeatedly and a ratio between "on" and "off" periods is controlled, thereby varying the power supply voltage applied to the wash pump motor 13.

The above-described operation control circuit 52 and drive circuit 53 constitute voltage control means 54, which means further constitutes both the rotational speed control means and the feed liquid pressure changing means. The voltage control means 54 constitutes the nozzle drive means.

In accordance with the second embodiment, the power supply voltage applied to the wash pump motor 13 is varied by the operation control circuit 52 and the drive circuit 53 in such a manner as shown in FIG. 5. That is, the wash pump 12 is driven at 100 V and then, at 80 V repeatedly. Consequently, since the rotational speed of the wash pump motor 13 is periodically changed, the pressure of the wash liquid fed to the spray nozzle 9 is periodically changed. As a result, the same effect can be achieved in the second embodiment as in the first embodiment.

As described above, the ratio between the "on" and "off" periods is controlled by energizing and deenergizing the wash pump motor 13 for the period corresponding to the several cycles of the a.c. power supply repeatedly. The control manner should not be limited to this one. A chopper control may be employed for varying the power supply voltage applied to the wash pump motor 13, for example. Furthermore, a.d.c. brushless motor may be employed as the wash pump motor 13 instead of the induction motor. In the case of the d.c. brushless motor, the rotational speed control can be performed more accurately by controlling the drive voltage and the energization timing.

Figure 7:
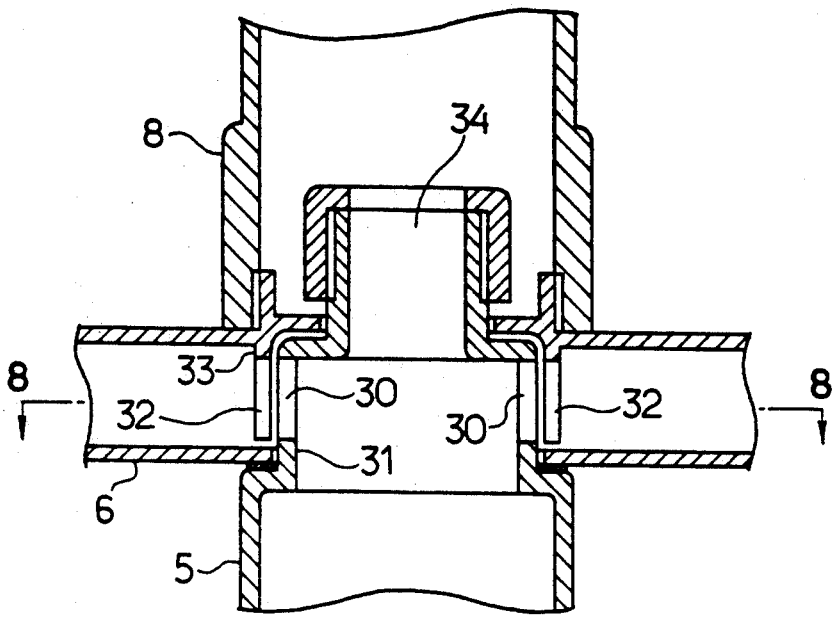
FIG. 7 is a longitudinal side sectional view of a liquid feed path and its peripheral portion of the dishwasher of a third embodiment.
Figure 8:
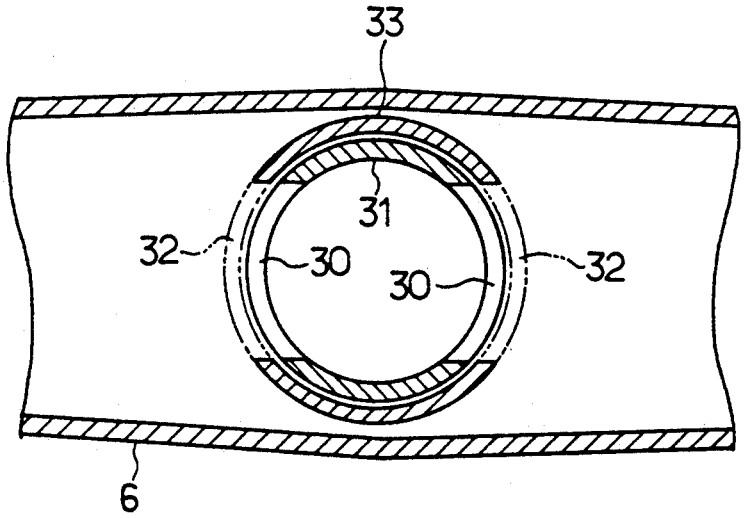
FIG. 8 is a transverse sectional view taken along line 8—8 in FIG. 7.

FIGS. 7 and 8 illustrate a third embodiment of the invention. The difference between the first and third embodiments will be described. The base pipe 5 has a cylindrical portion 31 extending upwards from its upper end. Two apertures 30 are formed in the peripheral wall of the cylindrical portion 31 so as to face the inside of the spray arm 6. Another cylindrical portion 33 is formed inside the spray arm 6 so as to encompass the cylindrical portion 31 of the base pipe 5. Two apertures 32 are also formed in the peripheral wall of the cylindrical portion 33 so as to correspond to the respective apertures 30 of the cylindrical portion 31. Upon rotation of the spray arm 6, the apertures 32 of the cylindrical portion 33 are displaced relative to the respective apertures 30 of the cylindrical portion 31 such that an area of opening of each aperture 30 is varied by the peripheral wall of the cylindrical portion 33.

An aperture 34 formed in the upper end of the cylindrical portion 31 faces the inside of the tower pipe 8 and is communicated to the spray nozzle 9. A liquid feed path is formed by the base pipe 5 and the cylindrical portion 31. The apertures 30 of the cylindrical portion 31 constitute an arm side liquid feed port of the liquid feed path and the aperture 34 of the cylindrical portion 31 constitute a nozzle side liquid feed port. The cylindrical portion 33 of the spray arm 6 and the cylindrical portion 31 of the base pipe 5 constitute flow rate adjusting means for adjusting the flow rate of the wash liquid flowing through the arm side liquid feed port, which flow rate adjusting means further constitutes both feed liquid pressure changing means and nozzle drive means.

In accordance with the above-described construction, the liquid feed to the spray arm 6 is substantially interrupted when rotation of the spray arm 6 causes the apertures 30 of the cylindrical portion 31 to be closed. As a result, the pressure of the wash liquid fed to the spray nozzle 9 is increased. A high pressure is thus applied to the spray nozzle 9, resulting in rise of the spray nozzle 9. On the other hand, when rotation of the spray arm 6 causes the apertures 32 to overlap the respective apertures 30 of the cylindrical portion 31, the apertures 30 are opened and accordingly, the wash liquid is fed to the spray arm 6, resulting in reduction in the pressure of the wash liquid fed to the spray nozzle 9. Consequently, since a low pressure is applied to the spray nozzle 9, it is caused to descend. The pressure of the wash liquid fed to the spray nozzle 9 is thus varied periodically with rotation of the spray arm 6 and the variation of the wash liquid pressure causes the spray nozzle 9 to rise up and descend. Consequently, the same effect can be achieved in the third embodiment as in the first embodiment.

Although the pressure of the wash liquid fed to the spray nozzle 9 is varied for the purpose of vertically moving the spray nozzle 9, in the foregoing embodiments, it may be vertically moved by an actuator comprising a motor, a solenoid or the like. Furthermore, the spring 10 interposed between the tower pipe 8 and the spray nozzle 9 may be eliminated when the spray nozzle 9 is formed of a metallic material and has a sufficiently large weight.

The foregoing disclosure and drawings are merely illustrative of the principles of the present invention and are not to be interpreted in a limiting sense. The only limitation is to be determined from the scopes of the appended claims.

I claim:

1. A dishwasher comprising:

a) a washing compartment defined in a cabinet for accommodating tableware and reserving a predetermined amount of wash liquid on the bottom;

b) a wash pump sucking the wash liquid reserved in the washing compartment and feeding the same;

c) a spray nozzle mounted in the washing compartment so as to be vertically moved, to be fed with the wash liquid from the wash pump and to spray the wash liquid to the tableware; and d) feed liquid pressure changing means for changing a pressure of the wash liquid fed to the spray nozzle during washing the tableware with the wash liquid sprayed from the spray nozzle so that the wash liquid pressure is increased and decreased at a plurality of times, thereby reciprocally driving the spray nozzle vertically at a plurality of times.

2. A dishwasher according to claim 1, wherein the wash pump comprises a drive motor and the feed liquid pressure changing means comprises rotational speed control means for controlling the rotational speed of the drive motor of the wash pump.

3. A dishwasher according to claim 2, wherein the rotational speed changing means comprises inverter control means for controlling the frequency of a power supply to the drive motor of the wash pump.

4. A dishwasher according to claim 2, wherein the rotational speed changing means comprises voltage control means for controlling a power supply voltage applied to the drive motor of the wash pump.

5. A dishwasher according to claim 1, which further comprises a spray arm rotatably mounted in the washing compartment so as to be fed with the wash liquid from the wash pump and spraying the wash liquid to the tableware from below the tableware, a liquid feed path having an arm side liquid feed port from which the wash liquid from the wash pump is fed to the spray arm and a nozzle side liquid feed port from which the wash liquid from the wash pump is fed to the spray nozzle, and flow rate adjusting means varying an area of opening of the arm side liquid feed port in accordance with rotation of the spray arm for adjusting the flow rate of the wash liquid flowing through the arm side liquid feed port, and wherein the feed liquid pressure changing means comprises the flow rate adjusting means.

6. A dishwasher comprising:

a) a washing compartment defined in a cabinet for containing tableware and reserving a predetermined amount of wash liquid on the bottom;

b) a wash pump sucking the wash liquid reserved in the washing compartment and feeding the wash liquid, the wash pump including a drive motor;

c) a cylindrical liquid feed member standing on the bottom of the washing compartment for receiving the wash liquid from the wash pump, the cylindrical liquid feed member having an upper end opening;

d) a spray arm rotatably mounted on the upper portion of the cylindrical liquid feed member for spraying the wash liquid therefrom to the tableware from below the tableware;

e) a cylindrical nozzle support member mounted on the spray arm so as to be communicated to the upper end opening of the cylindrical liquid feed member;

f) a spray nozzle inserted in the cylindrical nozzle support member so as to be vertically moved, the spray nozzle receiving the wash liquid fed from the cylindrical liquid feed member and the cylindrical nozzle support member to inject the wash liquid to the tableware;

g) a spring mounted between the spray nozzle and the cylindrical nozzle support member for urging the spray nozzle downward; and h) rotational speed control means for controlling the rotational speed of the drive motor of the wash pump so that the pressure of the wash liquid fed to the spray nozzle is varied to be increased and decreased at a plurality of times, thereby reciprocally driving the spray nozzle vertically at a plurality of times during washing the tableware with the wash liquid sprayed from the spray nozzle.

* * * * *